US008322841B2

(12) United States Patent
Lang et al.

(10) Patent No.: US 8,322,841 B2
(45) Date of Patent: Dec. 4, 2012

(54) INKJET PRINTING APPARATUS

(75) Inventors: Joseph Herman Lang, Webster, NY (US); Gregory Joseph Kovacs, Webster, NY (US); Peter Gordon O'Dell, Mississauga (CA); Jeffrey William Drawe, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 353 days.

(21) Appl. No.: 12/725,116

(22) Filed: Mar. 16, 2010

(65) Prior Publication Data

US 2011/0228024 A1 Sep. 22, 2011

(51) Int. Cl.
*B41J 2/01* (2006.01)

(52) U.S. Cl. ..... 347/102; 174/257; 270/58.15; 347/50; 347/85; 347/100

(58) Field of Classification Search ..... None
See application file for complete search history.

(56) References Cited

U.S. PATENT DOCUMENTS

| | | | | |
|---|---|---|---|---|
| 5,001,500 | A * | 3/1991 | Wolfberg et al. | 347/118 |
| 6,699,352 | B2 * | 3/2004 | Sawatsky | 156/277 |
| 7,665,817 | B2 | 2/2010 | Folkins | |
| 7,798,632 | B2 * | 9/2010 | Hoshino | 347/102 |
| 8,070,282 | B2 * | 12/2011 | Nakazawa | 347/102 |
| 2002/0085054 | A1 * | 7/2002 | Tokie | 347/15 |
| 2005/0190248 | A1 * | 9/2005 | Konno et al. | 347/102 |
| 2007/0120924 | A1 * | 5/2007 | Odell et al. | 347/100 |
| 2008/0218570 | A1 * | 9/2008 | Kovacs et al. | 347/88 |
| 2009/0265950 | A1 | 10/2009 | Mizes et al. | |
| 2010/0013882 | A1 | 1/2010 | Mizes et al. | |

OTHER PUBLICATIONS

Technology Backgrounder: HP Inkjet Web Press, Hewlett-Packard Development Company, L.P., Apr. 2009 (16 pages).

* cited by examiner

*Primary Examiner* — Matthew Luu
*Assistant Examiner* — John P Zimmermann
(74) *Attorney, Agent, or Firm* — Maginot, Moore & Beck, LLP

(57) ABSTRACT

A printing apparatus has been developed that prints inkjet images on a continuous web with a configurable number of distinct ink colors. The printing apparatus includes a frame configured to support a plurality of components to form a printing system, the frame including a plurality of mounting locations, a plurality of printing system components including at least one printhead array and at least one first ink composition curing assembly, each printing system component in the plurality of printing system components being configured to mount to a mounting location on the frame, and the printing apparatus being enabled to eject a first ink composition onto an image receiving surface when a first set of printing system components selected from the plurality of printing system components is mounted to the frame and being enabled to eject a second ink composition onto an image receiving surface when a second set of printing system components selected from the plurality of printing system components is mounted to the frame, the second set of printing system components not including a first ink composition curing assembly.

20 Claims, 10 Drawing Sheets

INKJET PRINTING APPARATUS

TECHNICAL FIELD

The process and apparatus described below relate to imaging devices and, more particularly, to inkjet imaging devices.

BACKGROUND

Drop on demand inkjet technology for producing images on print media has been employed in products such as printers, multifunction devices, plotters, and facsimile machines. Generally, an inkjet image is formed by selectively ejecting ink droplets from a plurality of drop generators or inkjets, which are arranged in a printhead or a printhead array, onto an image receiving substrate. For example, the printhead array and the image receiving substrate may be moved relative to one other and the inkjets may be controlled to emit ink drops at appropriate times. The timing of the inkjet activation is performed by a printhead controller, which generates firing signals that activate the inkjets to eject ink. The image receiving substrate may be an intermediate image member, such as a print drum or belt, from which the ink image is later transferred to a print medium, such as paper. The image receiving substrate may also be a moving continuous web of print medium or sheets of a print medium onto which the ink drops are directly ejected. The ink ejected from the inkjets may be liquid ink, such as aqueous, solvent, oil based, UV curable ink, or the like, each of which may be stored in containers installed in the printer. Alternatively, the ink may be loaded in a solid or a gel form and delivered to a melting device, which heats the ink to generate liquid ink that is supplied to a printhead.

An inkjet printer may be configured to form printed images across a broad color spectrum; however, most inkjet printers form printed images with a predetermined and fixed number of distinct ink colors. For example, a full color ink jet printer may be configured to print color images with only four distinct ink colors; namely, cyan, magenta, yellow, and black. If a print job requires an image to be printed with five or more colors of ink a different inkjet printer is utilized. Therefore, an inkjet printer having a configurable number of ink colors is desirable.

Additionally, known inkjet printers form printed images with a fixed print resolution for each ink color. The print resolution of an ink color refers to the number of ink drops ejected onto an image receiving substrate within a defined length. A maximum print resolution of an ink color in the cross process direction is a hardware characteristic that is determined by the total number of ink ejectors per unit length in the cross process direction of the printheads configured to eject the ink color. A print resolution of an ink color in the cross process direction may be reduced from the maximum print resolution with software that causes the inkjet printer to use fewer than all of the ink ejectors in a printhead to eject ink onto the image receiving substrate. The print resolution of an ink color may not, however, be increased above the maximum print resolution because additional ink ejectors cannot be added to known inkjet printing systems. Therefore, increased flexibility in the print resolution of inkjet printer is desirable.

SUMMARY

A printing apparatus has been developed that prints inkjet images on a continuous web with a configurable number of distinct ink colors. The printing apparatus includes a frame configured to support a plurality of components to form a printing system, the frame including a plurality of mounting locations, a plurality of printing system components including at least one printhead array and at least one first ink composition curing assembly, each printing system component in the plurality of printing system components being configured to mount to a mounting location on the frame, and the printing apparatus being enabled to eject a first ink composition onto an image receiving surface when a first set of printing system components selected from the plurality of printing system components is mounted to the frame, and being enabled to eject a second ink composition onto an image receiving surface when a second set of printing system components selected from the plurality of printing system components is mounted to the frame, the second set of printing system components not including a first ink composition curing assembly.

A printing system has been developed that prints inkjet images onto a continuous web with a configurable number of distinct ink colors and with a configurable print resolution. The printing system includes a first frame configured with a first plurality of printing system component mounting locations, a second frame configured with a second plurality of printing system component mounting locations, and a plurality of printing system components including at least two printhead arrays and at least two first ink composition curing assemblies, each frame being configurable to form a printing apparatus that ejects a first ink composition or a second ink composition onto an image receiving surface, a frame being configured to form a printing apparatus that ejects a first ink composition when a first set of printing system components selected from the plurality of printing system components is mounted to the frame and a frame being configured to form a printing apparatus that ejects a second ink composition when a second set of printing system components is mounted to the frame, the second set of printing system components not including a first ink composition curing assembly, and the printing apparatus formed on the second frame is configured to receive the image receiving surface from the printing apparatus formed on the first frame after the printing apparatus formed on the first frame has ejected ink onto the image receiving surface.

BRIEF DESCRIPTION OF THE FIGURES

The foregoing aspects and other features of the present disclosure are explained in the following description, taken in connection with the accompanying drawings.

DETAILED DESCRIPTION

The system and method described herein make reference to a printer. The term "printer" refers, for example, to reproduction devices in general, such as printers, facsimile machines, copiers, and related multi-function products. While the specification focuses on an inkjet printer, the apparatus and method described herein may be used with any reproduction device that ejects ink onto an image receiving surface.

Figure 1:
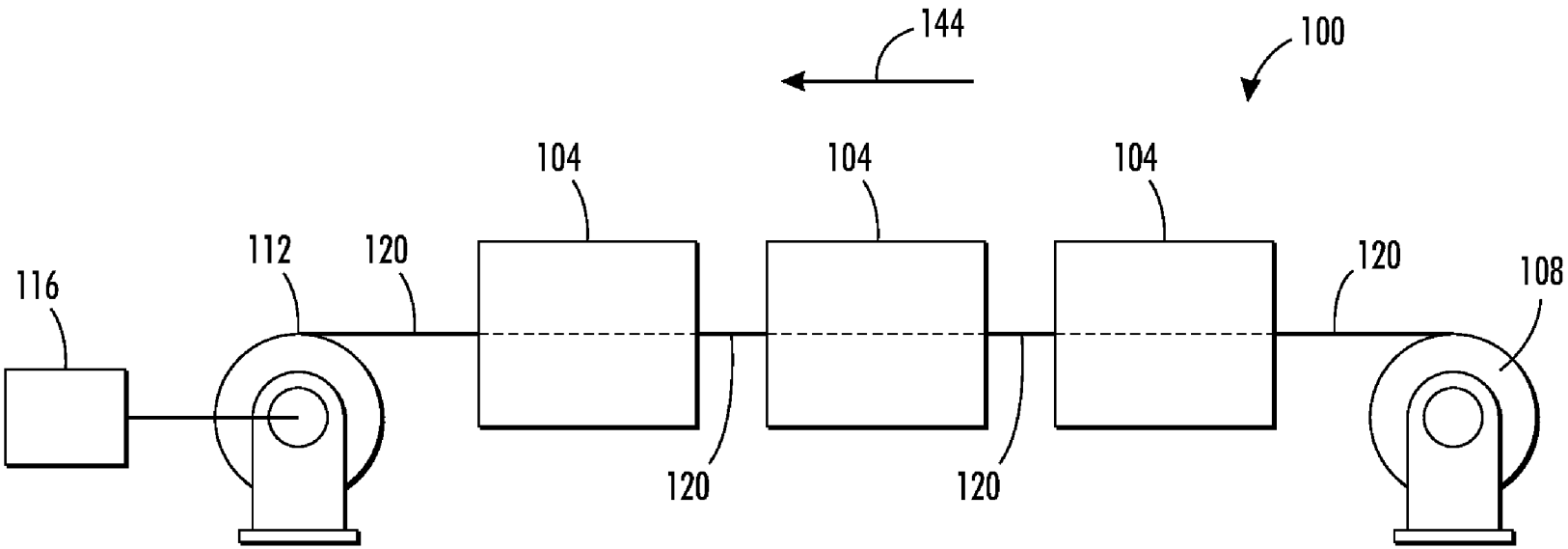
FIG. 1 is a block diagram of a printing system, as disclosed herein, including a plurality of printing apparatus serially connected.

As shown in FIG. 1, a printing system 100 is provided for forming printed images on an image receiving surface. The printing system 100 includes one or more printing apparatus 104, each of which eject ink onto the image receiving surface. As shown in the figure, the image receiving surface is a continuous web of print medium, although the image receiving surface may be a series of media sheets. Each printing apparatus 104 includes a frame to which a particular set or a portion of a particular set of printing system components has been mounted. The printing apparatus formed on the frame ejects one particular ink composition of numerous ink compositions. Additionally, each ink color and ink type ejected by the printing system 100 may have one of numerous print resolutions. Although three printing apparatus 104 form the printing system 100 illustrated in FIG. 1, any number of printing apparatus 104 may be connected serially to form the printing system 100. Therefore, the printing system 100 may be configured to print images with any number of ink colors and/or ink types of one particular ink composition at the same or different print resolutions.

The printing system 100 includes a web supply 108, a rewinder 112, an actuator 116, and one or more printing apparatus 104. The print medium supply, referred to as a web supply 108, is a length of print medium that may be wound upon a spool and rotatably supported. The actuator 116 is coupled to the rewinder 112 to rotate the rewinder 112 and draw a continuous web 120 of print medium from the web supply 108 through each printing apparatus 104 in direction 144 of FIG. 1. In particular, the rewinder 112 pulls the continuous web 120 past each printing system component in each printing apparatus 104. The actuator 116 may be any actuator configured to generate and transmit rotational force to the rewinder 112, including, but not limited to, an electric motor coupled to a transmission system. The actuator 116 may be coupled to a source of electrical energy (not illustrated). As shown in FIG. 1, the image receiving surface processed by the first printing apparatus 104 may be fed to the second printing apparatus 104 to form a single printing system 100.

The printing system 100 is configurable to print images with one of numerous ink compositions. Exemplary ink compositions include, but are not limited to, phase change inks, gel based inks, curable inks, aqueous inks, and solvent inks. As used herein, an ink composition encompasses all colors and types of a particular ink composition including, but not limited to, usable color sets of an ink composition, gamut extender colors, and spot colors. For example, an ink composition may refer to a usable color set of phase change ink that includes cyan, magenta, yellow, and black inks. Therefore, as defined herein, cyan phase change ink and magenta phase change ink are different ink colors of the same ink composition. Similarly, an ink composition may also refer to an overcoat, varnish, or clear coat that is applied on top of an image formed on the continuous web 120. Additionally, an ink composition may refer to a surface preparation, including, but not limited to, base coats and undercoats, that prepare the continuous web 120 to receive additional ink. The term "ink composition" includes inks of all colors having magnetic or other reactive properties. For example, a particular subset of an ink composition may have magnetic properties, which may be used, for among other purposes, to verify the authenticity of a printed document, such as a bank check in a magnetic ink character recognition ("MICR") system.

The printing system 100 may include one or more printing apparatus 104 that eject phase change ink. As used herein, the term "phase change ink", also referred to as "solid ink", encompasses inks that remain in a solid phase at an ambient temperature and that melt into a liquid phase when heated above a threshold temperature, referred to as a melt temperature. In particular, the term "phase change" includes usable color sets of phase change ink as well as overcoats, varnishes, and surface preparations of phase change ink. When phase change ink cools below the threshold temperature the ink returns to the solid phase. The loss modulus of phase change ink in the solid phase is greater than the loss modulus of phase change ink in the liquid phase. For example, the loss modulus of phase change ink in the solid phase may be approximately six orders of magnitude greater than the loss modulus of phase change ink in the liquid phase. Phase change ink is ejected onto an image receiving surface, such as the continuous web 120, in the liquid phase. The ambient temperature is the temperature of the air surrounding the printing system 100 and/or a particular printing apparatus 104; however, the ambient temperature may be a room temperature when the printing system 100 and/or the printing apparatus 104 are positioned in a defined space. The ambient temperature may deviate from a room temperature at various positions along a path taken by the continuous web 120, including, but not limited to a print zone opposite the printhead arrays 128 (FIGS. 3 and 4), which are described below. An exemplary range of melt temperatures for phase change ink is approximately seventy to one hundred forty degrees Celsius; however, the melt temperature of some phase change inks may be above or below the exemplary temperature range. Phase change inks are also described in, for example, U.S. Pat. No. 7,407,539 and U.S. Pat. No. 7,377,971.

The printing system 100 is also configurable to form printed images with gel ink. The terms "gel ink" and "gel based ink", as used herein, encompass inks that remain in a gelatinous state at the ambient temperature and that may be heated or otherwise altered to have a different viscosity, often a lower viscosity, suitable for ejection by a printhead array 128. In particular, the term "gel ink" includes usable color sets of gel ink as well as overcoats, varnishes, and surface preparations of gel ink. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately sixty to seventy degrees Celsius; however, the gelation temperature of some gel inks may be above or below the exemplary temperature range. The viscosity of gel ink increases when the ink cools below the gelation temperature.

Some ink compositions, referred to herein as curable inks, are cured in a printing apparatus 104 during the printing process. As used herein, the process of "curing" ink refers to curable compounds in an ink undergoing an increase in molecular weight upon exposure to radiation, such as by crosslinking, chain lengthening, or the like. Cured ink is suitable for document distribution, is resistant to smudging, and may be handled by a user. Radiation curable ink becomes cured after being exposed to a source of radiation. Radiation suitable to cure ink may encompass the full frequency (or wavelength) spectrum including, but not limited to, visible, ultraviolet, and electron beam radiation, which is commonly referred to as "e-beam" radiation. In particular, ultraviolet-curable ink, referred to herein as UV ink, becomes cured after being exposed to ultraviolet radiation. As used herein, the term "ultraviolet" encompasses the range of wavelengths of light from approximately two hundred nanometers to approximately four hundred nanometers.

Curable ink may be configured in a gel form. In particular, ultraviolet-curable gel ink, referred to in this document as UV gel ink, is a gelatinous UV ink that is heated to transition the ink to a liquid form for jetting onto an image receiving surface and later exposed to UV radiation to cure the ink. One advantage of UV gel ink is the return of the ink to the gelatinous state once the ink lands on the image receiving surface. The gelling of the ink retards the absorption of the ink by the image receiving surface to enable the ink to be overprinted with ink from subsequent printhead arrays. UV inks that are not gel inks require a pinning lamp to be mounted to the frame of a printing apparatus to retard the absorption of the ink by the image receiving surface sufficiently to enable overprinting by subsequent printhead arrays. Ultraviolet gel ink is described in U.S. Pat. No. 7,632,546; U.S. Pat. No. 7,625,956; and U.S. Pat. No. 7,501,015.

Figure 2:
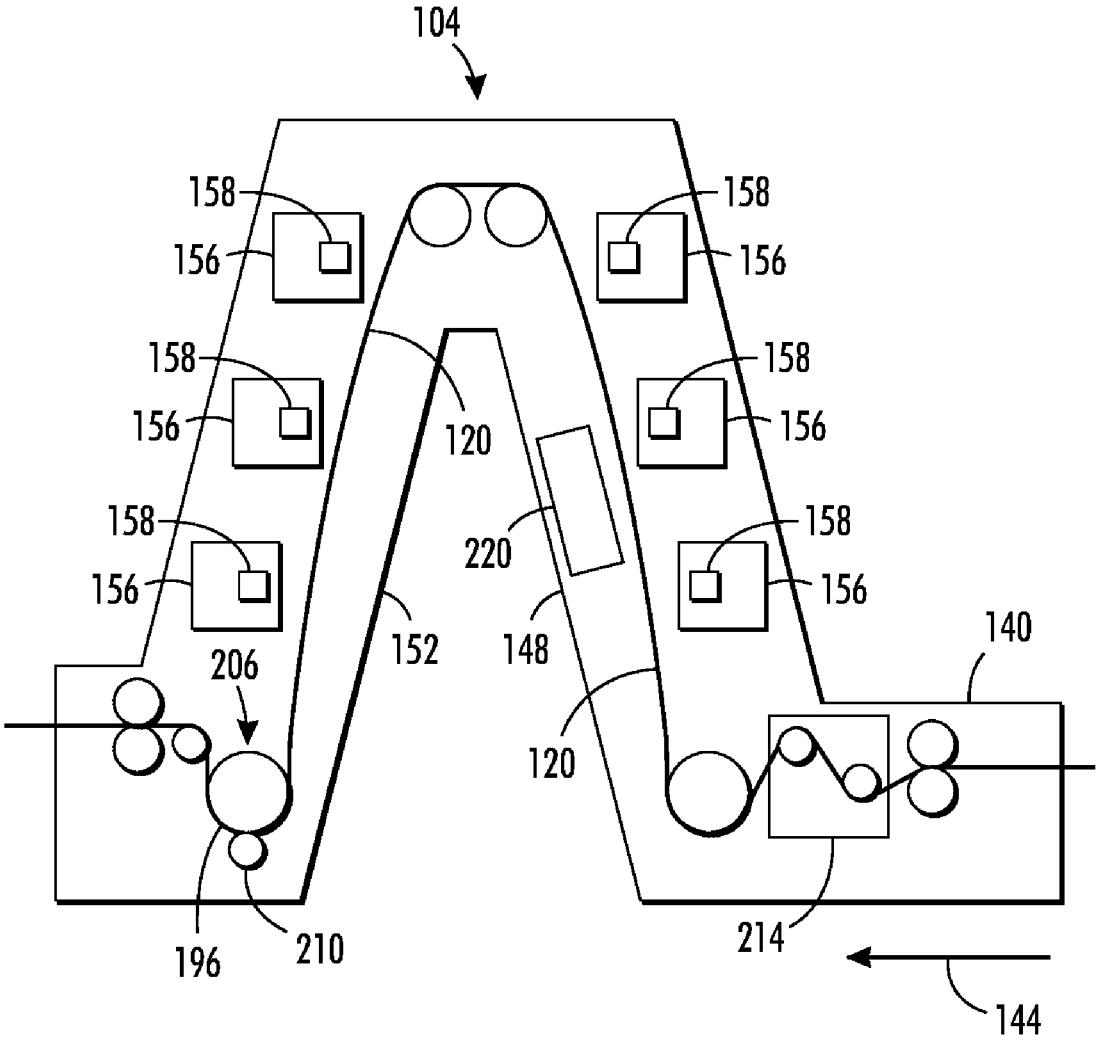
FIG. 2 illustrates a frame of a printing apparatus for use with the printing system of FIG. 1, the printing apparatus includes a frame with mounting locations for coupling printing system components to the frame.
Figure 3:
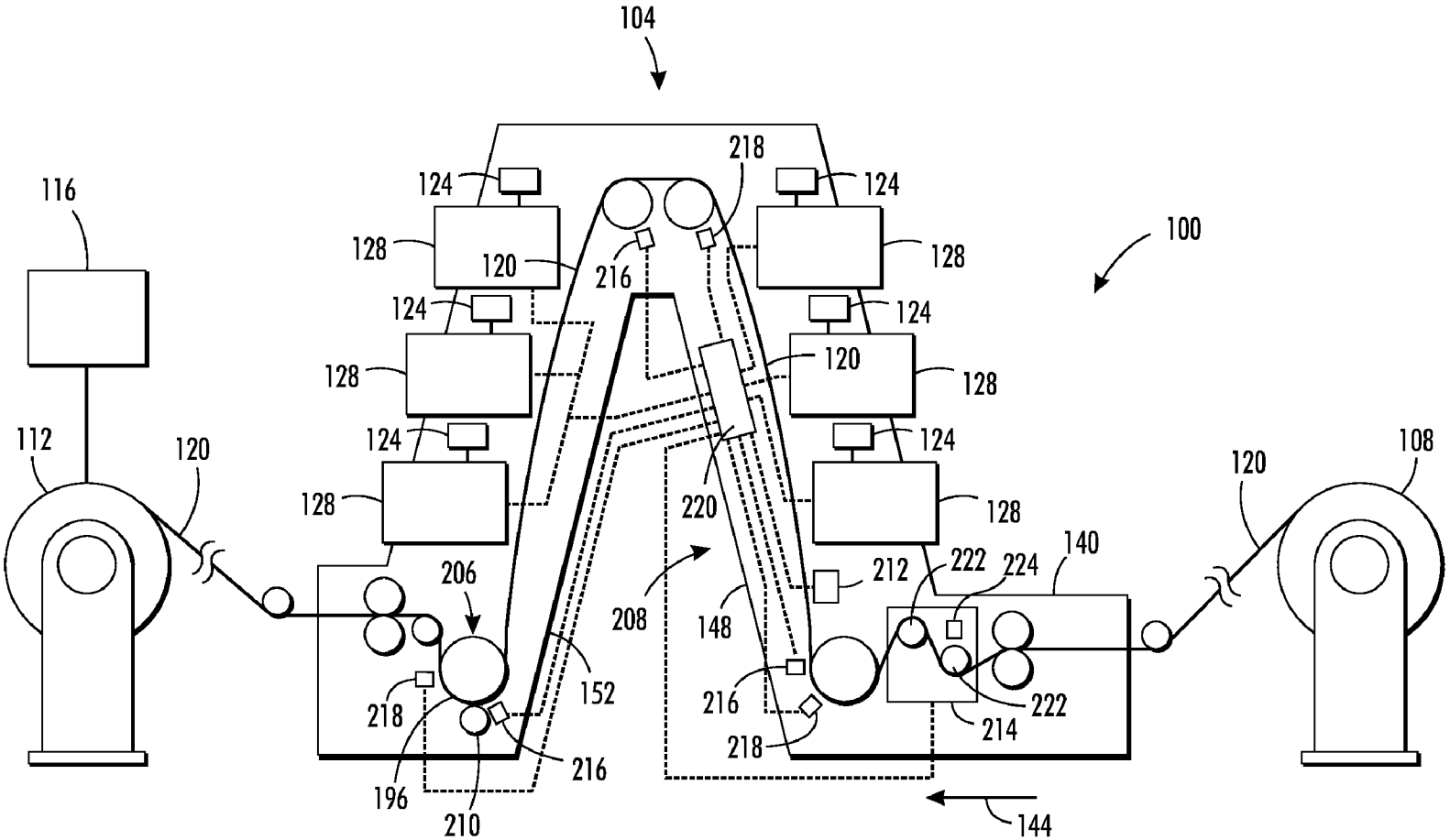
FIG. 3 illustrates the frame of FIG. 2 having been populated with printing system components to form a phase change ink printing system.

A frame 140 of a printing apparatus 104 is shown in FIG. 2. The frame 140 includes a plurality of mounting locations 156, a positioning device 214, an ink spreader 206, and a registration processor 220. Printing system components are mounted to the mounting locations 156 to form a printing apparatus. Each mounting location 156 is depicted as including a support bracket 158 to facilitate the mounting of a printing system component to a mounting location 156, although other mounting structures may be used to mount printing system components to a frame 140. The registration processor 220 operates as described more fully below to determine the velocity of the web moving through the print zone. The print zone, as used herein, refers to the portion of the media path opposite the mounting locations 156. The registration processor 220 is configured to generate control signals that operate the positioning device 214 to move the continuous web 120 in a cross-process direction 146 (FIG. 8) for image registration purposes. The positioning device 214 is an electromechanical device consisting of a plurality of web rollers 222 and at least one electric motor 224 (FIG. 3). The registration processor 220 may operate the electric motor 224 to reposition one or more of the web rollers 222 such that the position of the continuous web 120 is adjusted in the cross process direction 146. The ink spreader 206 includes a roller 196 that cooperates with the roller 210 to fix or spread ink images, other than curable ink images, to the image receiving surface. The roller 210 is positioned in intimate contact with roller 196, such that as the rewinder 112 draws the continuous web 120 between the roller 196 and the roller 210, the ink droplets ejected onto the continuous web 120 are flattened, causing adjacent ink droplets to contact each other and form a substantially continuous area of ink. The spreader roller 210 may be biased against the roller 196. In some embodiments, the ink spreader 206 may be coupled to a mounting location 156. A suitable composition of ink fixed by the ink spreader 206 includes phase change ink, among other ink compositions. A curing assembly is mounted to a mounting location 156 prior to the ink spreader 206 when a curable ink composition is ejected by the printing apparatus 104 because some pressure bearing structure surfaces contacting curable inks prior to curing of the ink may result in the adhesion of a portion of the ink to the structure and the severe degradation of image quality.

Figure 9:
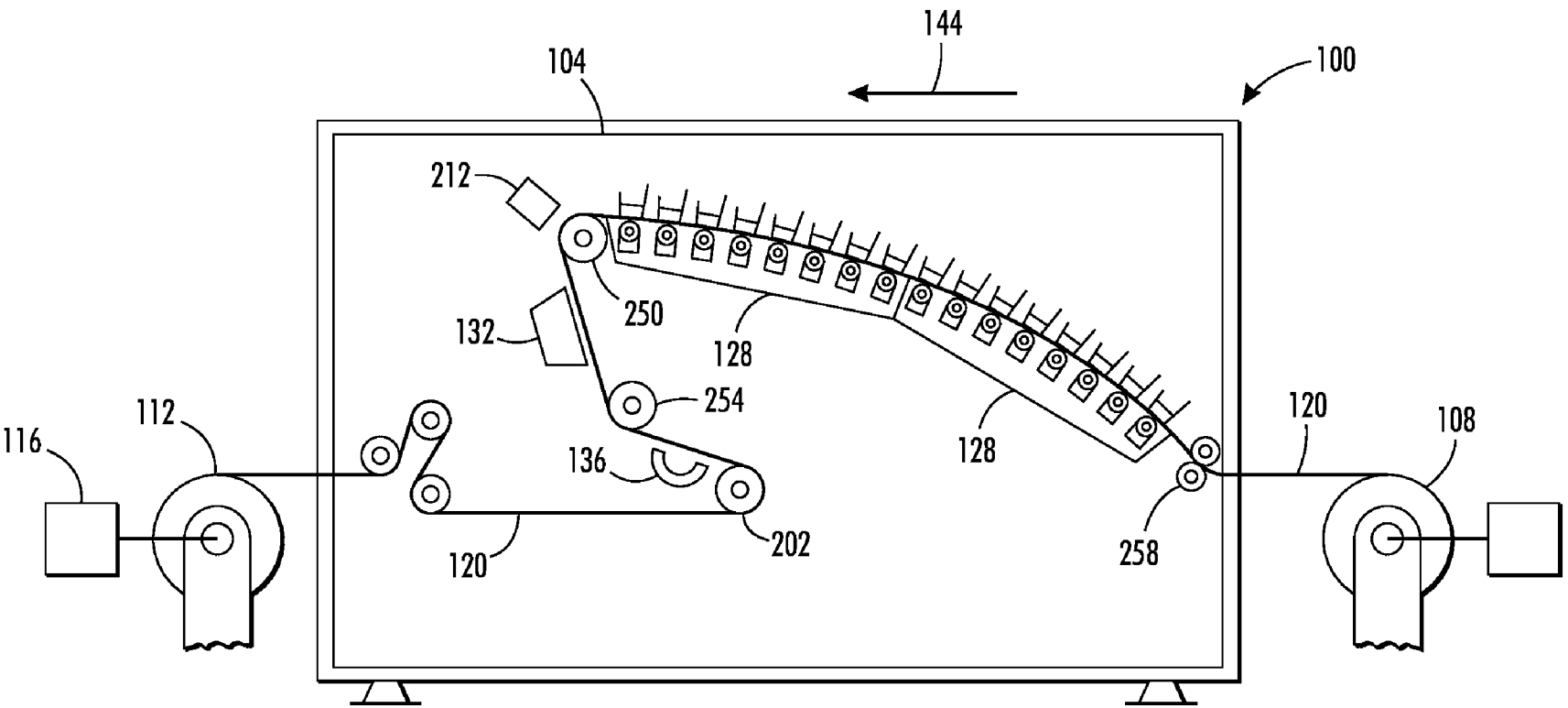
FIG. 9 illustrates an alternative embodiment of a frame of a printing apparatus for use with the printing system of FIG. 1, the frame having been populated with printing system components.
Figure 10:
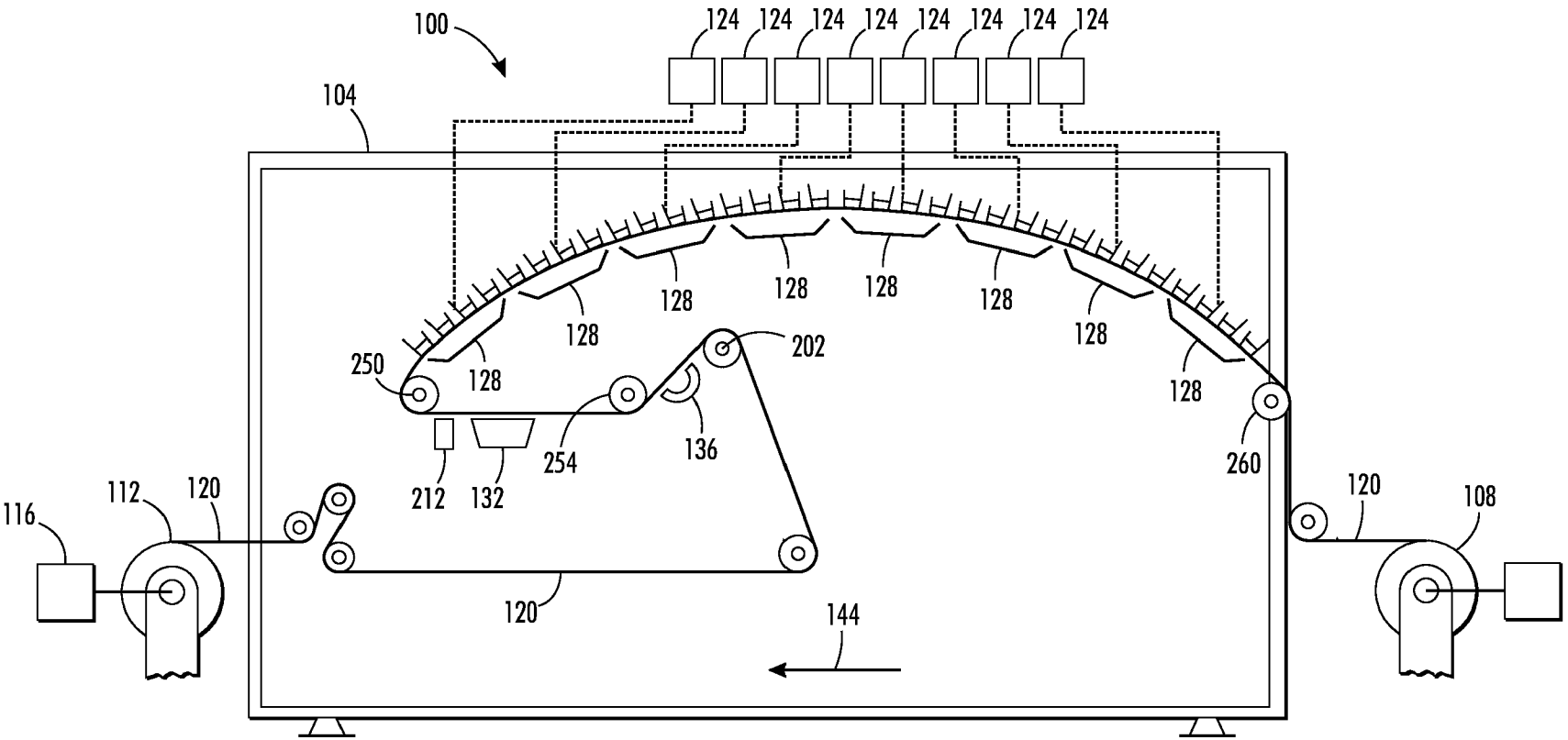
FIG. 10 illustrates an alternative embodiment of a frame of a printing apparatus for use with the printing system of FIG. 1, the frame having been populated with printing system components configured to print images with eight colors of a curable ink composition.

The frame 140 may define a media path having a profile that is suited to the printing system components that are mounted to the frame 140. In the illustrated embodiments, the frame 140 is an A-shaped frame having an inclined portion 148 and a declined portion 152. The inclined portion 148 and the declined portion 152 form an apex that gives the frame 140 and the media path a generally A-shape profile. The media path extends up the inclined portion 148 and down the declined portion 152 in a process direction 144. In other embodiments, the frame 140 may define a media path that is generally horizontal or, as shown in FIGS. 9 and 10, the frame 140 may define a media path that is generally arcuate in profile. The frame 140 illustrated in FIG. 2 includes six mounting locations 156; however, other embodiments of the frame 140 may include a different number of mounting locations 156. For example, a frame 140 configured to support four printing system components includes at least four mounting locations 156, and a frame 140 configured to support nine printing system components includes at least nine mounting locations 156. The length of the inclined portion 148 and the length of the inclined portion 152 depend in part on the total number of mounting locations 156.

As used herein, "printing system component" means a device that ejects ink onto an image receiving surface or that processes ink on an image receiving surface to form ink patterns on the image receiving surface. Printing system components include, but are not limited to, printhead arrays, ink leveling devices, ink curing devices, image receiving surface imaging devices, transfix rollers, and the like. As described in more detail below, a manufacturing facility has access to a plurality of printing system components. Some of the printing system components enable a printing apparatus 104 to form ink images on an image receiving surface with a first ink composition, while other printing system components enable a printing apparatus 104 to form ink images with another ink composition. A set of printing system components that enable a printing apparatus 104 to form ink images with a first ink composition may include printing system components that cannot be included in another set of printing system components that enable a printing apparatus 104 to form ink images with another ink composition. For example, a set of printing system components that enable a printing apparatus 104 to print ink images with UV gel ink requires a curing assembly to cure the UV gel ink. A set of printing system components that enable a printing apparatus 104 to print ink images with a non-curable ink, on the other hand, would not include a curing assembly as the ink does not require curing. Both sets, however, may include printhead arrays 128 that operate the same, but are supplied with the different ink compositions to form the different printing apparatus 104.

Figure 4:
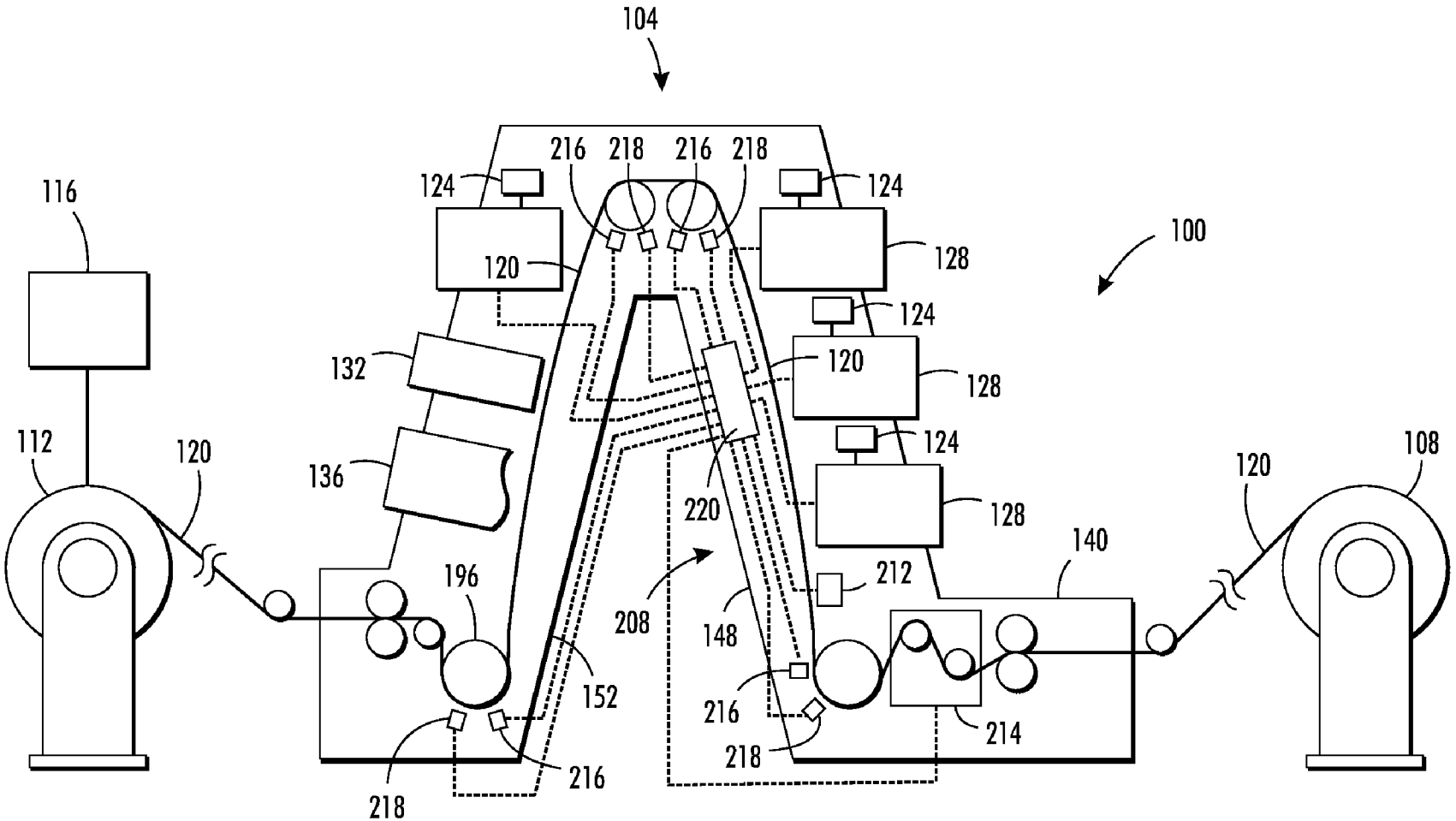
FIG. 4 illustrates the frame of FIG. 2 having been populated with printing system components to form a gel ink printing system.

As shown in FIG. 3, an exemplary set of printing system components is mounted to a frame 140 to form a printing apparatus 104 that prints ink images with a particular ink composition. As shown in FIG. 4, another exemplary set of printing system components is mounted to a frame 140 to form a printing apparatus 104 that prints ink images with another particular ink composition. The set of printing system components used in FIG. 3 includes six (6) printhead arrays 128, while the set of printing system components used in FIG. 4 includes four (4) printhead arrays 128, one (1) ink curing device 136, and one (1) ink leveling device 132. Thus, the printing apparatus 104 formed on a frame 140 corresponds to the printing system components mounted to the frame 140 and the type of ink supplied to the printhead arrays 128. Because the printing apparatus 104 depicted in FIG. 3 is supplied with solid ink, it is a solid ink printing apparatus 104 that may print images with up to six different types or colors of solid ink depending upon the colors or types of ink supplied to the printhead arrays 128. The four printhead arrays 128 in the printing apparatus 104 shown in FIG. 4 are supplied with UV gel ink and an ink leveling device 132 and an ink curing device 136 are coupled to the frame 140 to form a UV gel ink printing apparatus 104. The UV gel ink printing apparatus 104 may print with up to four different color inks or ink types.

The printhead arrays 128 eject the liquid ink contained by the ink sources 124 onto the continuous web 120 as the rewinder 112 pulls the continuous web 120 past the frame 140. The number of printhead arrays 128 coupled to the frame 140 depends on, among other considerations, the number of ink colors and types that are required to form a desired image. A printhead array 128 may be coupled to each location 156 of the frame 140. Each printhead array 128 may be fluidly connected to any one or more of the ink sources 124. Each printing apparatus 104 includes ink sources 124 that contain a quantity of liquid ink for ejection onto the continuous web 120. The term "liquid ink" as used herein, includes, but is not limited to, aqueous inks, liquid ink emulsions, pigmented inks, phase change inks in the liquid phase, and gel inks having been heated or otherwise treated to alter the viscosity of the ink for improved jetting. In the exemplary embodiments of FIGS. 3 and 4, each printhead array 128 is fluidly connected to the nearest ink source 124. The printhead arrays 128 may be configured to eject ink onto the continuous web 120 in any of a plurality of directions, including generally vertical and generally horizontal. As used herein, vertical refers to a direction that is within ±15 degrees of the direction of gravitational pull exerted on a printhead array 128 mounted to the frame 140 of the printing apparatus 104 and horizontal refers to a direction that is within ±30 degrees of the direction that is perpendicular to the gravitational pull exerted on a printhead array 128 mounted to the frame 140 of the printing apparatus 104. The printing apparatus 104 depicted in FIG. 2, FIG. 3, and FIG. 4 eject ink in a horizontal direction, while the printing apparatus 104 in FIG. 9 and FIG. 10 ejects ink in a vertical direction.

Figure 5:
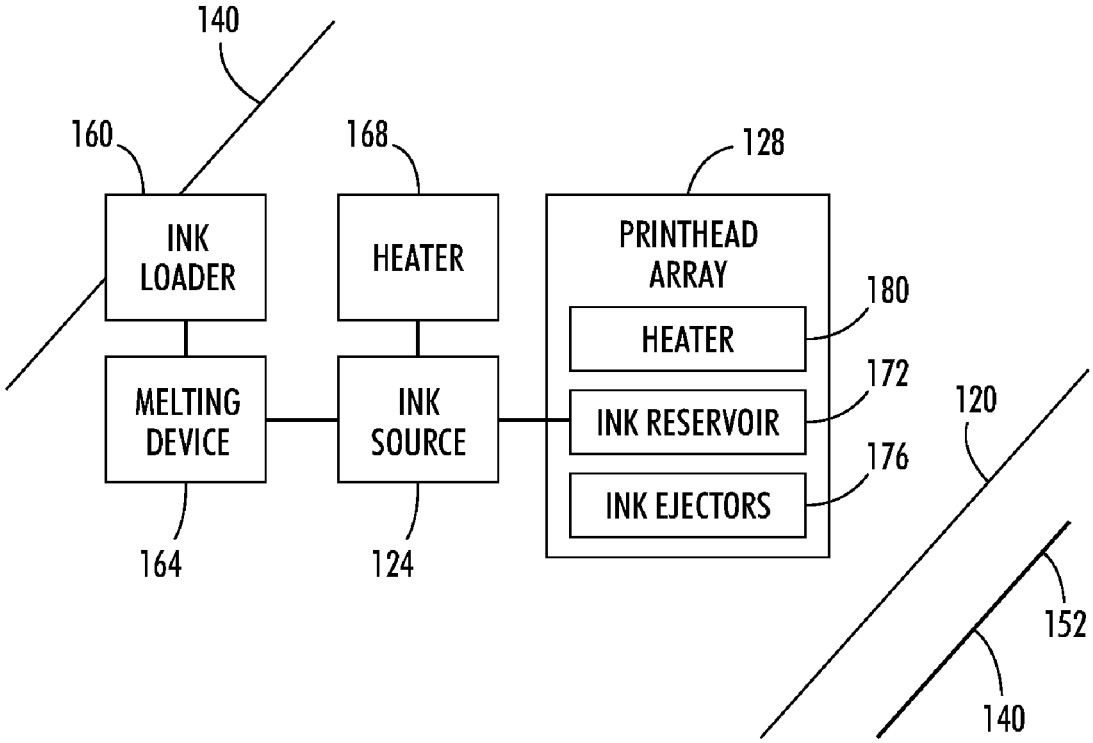
FIG. 5 illustrates a printhead array for use with the phase change ink printing system of FIG. 3 and the gel ink printing system of FIG. 4, the printhead array is coupled to an ink loader, a melting device, and an ink source.

As shown in the portion of the printing apparatus 104 illustrated in FIG. 5, a printhead array 128 configured to form images with an ink composition, such as, but not limited to, phase change ink and gel ink may include an ink loader 160, a melting device 164, and a heater 168 coupled to each ink source 124. When the printing apparatus 104 is configured to form printed images with phase change ink, the ink loader 160 contains a quantity of phase change ink in the solid phase. Phase change ink is supplied to the ink loader 160 as solid ink pellets or solid ink sticks, among other forms. The ink loader 160 moves the phase change ink toward the melting device 164, which melts a portion of the ink into the liquid phase. The liquid ink is delivered to an ink source 124, which is thermally coupled to heater 168. The heater 168 is configured to heat the ink source 124 to a temperature that maintains the phase change ink in the liquid phase. Liquid ink from the ink source 124 is delivered to a printhead array 128. In particular, the ink is delivered to an ink reservoir 172 within the printhead array 128. The ink reservoir 172 is fluidly coupled to a plurality of ink ejectors 176 configured to eject the liquid ink onto the continuous web 120. The ink ejectors 176 may be thermal ink ejectors and/or piezoelectric ink ejectors, among other types of ink ejectors, as is known in the art. The printhead array 128 also includes a heater 180 for maintaining the ink contained by the ink reservoir 172 in the liquid phase.

In a printing apparatus 104 configured to form images with gel ink, a quantity of gel ink may be loaded directly into the ink source 124. Heater 168 heats the ink source 124 to heat the gel ink and maintain the gel ink at a liquid-like viscosity. The gel ink from the ink source 124 is transferred to the reservoir 172 in the printhead 128 for ejection by the ink ejectors 176. Heater 180 heats the reservoir 172 to maintain the liquid-like viscosity of the gel ink contained in the reservoir 172. The ink source 124 and the reservoir 172 may be configured to remain connected to the printing apparatus 104 during normal usage and servicing of the printing apparatus 104. Specifically, when the ink level in the reservoir 172 falls below a threshold level, the printing apparatus 104 is configured to refill the reservoir 172 with ink (either phase change ink, UV gel ink, or another ink composition) from the ink source 124. Similarly, when the ink level in the ink source 124 falls below a threshold level, the printing apparatus 104 is configured to fill the ink source 124 with additional liquid ink from the ink loader 160. Accordingly, in one embodiment, neither the ink source 124 nor the reservoir 172 are disposable units configured to be replaced when the printing apparatus 104 exhausts an ink supply.

Another printing system component that may be coupled to a frame 140 is a non-contact ink spreader 132, as shown in FIG. 4. The ink spreader 132 is configured to spread ink droplets ejected onto the continuous web 120 into a substantially continuous area without physically contacting the ink droplets, as described below. In particular, when ink droplets contact the continuous web 120 there may be a space between each ink droplet and a plurality of surrounding ink droplets. The ink spreader 132 flattens the ink droplets such that each ink droplet contacts one or more adjacent ink droplets to form a continuous area of ink. The ink spreader 132 is commonly used to spread gel ink; however, the ink spreader 132 is not limited to spreading only gel ink.

Figure 6:
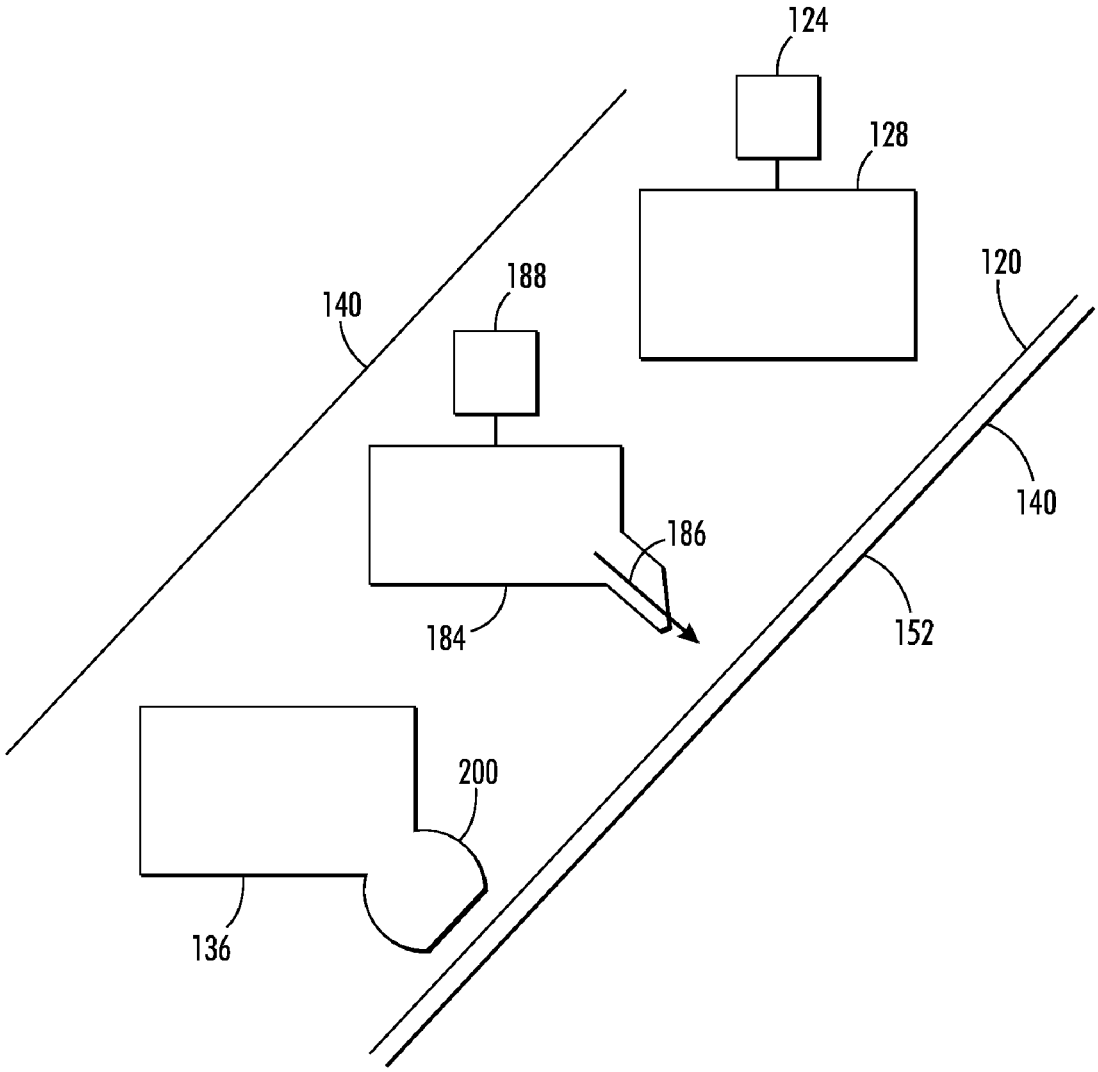
FIG. 6 illustrates a portion of the frame of the printing system of FIG. 4, an air knife ink spreader and a UV discharge lamp curing assembly are coupled to the portion of the frame.

The ink spreader 132 may be any known device configured to spread ink droplets including contact ink spreaders and non-contact ink spreaders. As shown in FIG. 6, a non-contact ink spreader 132 may be an air knife 184. The air knife 184 directs an air stream in direction 186 toward the ink droplets ejected on the continuous web 120. The air stream flattens the ink droplets and causes the ink droplets to contact one or more adjacent ink droplets to form a continuous area of ink. A heating element 188 may be coupled to the air knife 184 to heat the air stream directed at the ink droplets. In one embodiment, the heated air stream may spread the ink droplets with less air flow than an unheated stream. The heating element 188 may be any known type of heating element, such as a resistive heater coupled to a source of electrical energy.

Figure 7:
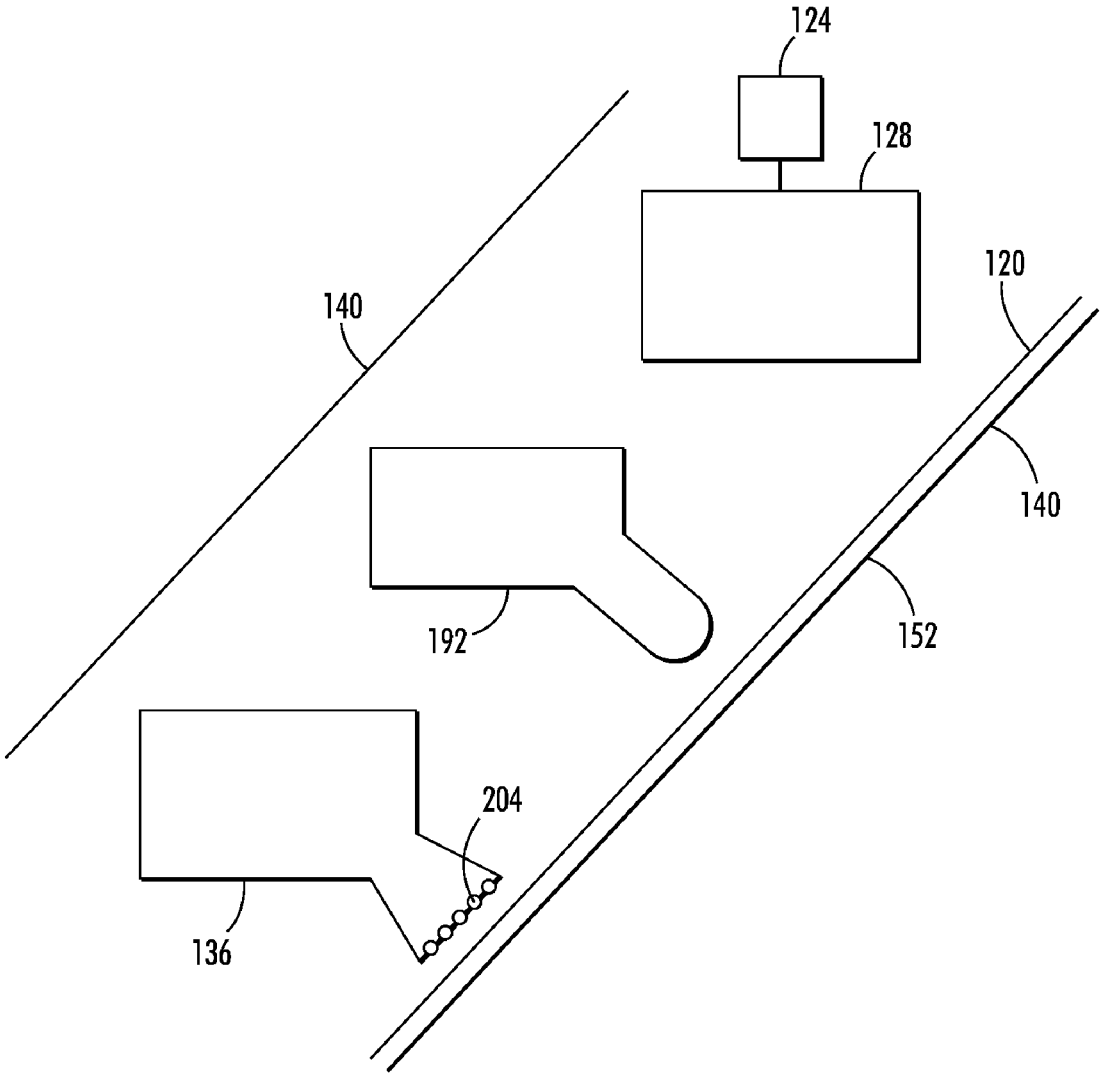
FIG. 7 illustrates a portion of the frame of the printing system of FIG. 4, an electric element ink spreader and a light emitting diode curing assembly are coupled to the portion of the frame.

As shown in FIG. 7, a non-contact ink spreader 132 may be an infrared radiation emitter 192 configured to emit infrared radiation. The infrared radiation heats the ink droplets ejected onto the continuous web 120 causing the viscosity of the ink droplets to decrease. As the viscosity of the ink droplets decreases, surface and interfacial tension forces spread the droplets which eventually contact each other to form a substantially continuous area of ink. The infrared radiation emitter 192 and the air knife 184 spread the ink droplets ejected onto the continuous web 120 without contacting the continuous web 120. Consequently, these devices are typically included in a set of printing system components used to form a printing device that uses an ink composition that adheres to a pressure bearing structure. As shown in FIGS. 9 and 10, the ink spreader 132 is positioned to spread the ink ejected onto the continuous web 120 before the ink undergoes contact with a pressure bearing structure surface, such as the roller 202.

In another embodiment, the ink spreader 132 may be a contact ink spreader. At least a portion of the contact ink spreader 132 physically contacts the ink droplets ejected onto the continuous web 120 to spread the ink droplets into a continuous area. The contact ink spreader 132, therefore, is made of a material configured to contact the ink droplets without adhering to the ink droplets. The contact ink spreader 132 achieves contact leveling and spreading and then cleanly separates from the ink and the continuous web 120 without offsetting or causing image defects.

Another printing system component is an ink curing assembly 136 configured to cure curable ink on the image receiving surface. The curing assembly 136 may be coupled to any one of the locations 156 (FIG. 2). The curing assembly 136 may also be coupled to other portions of the frame 140 configured for selective mounting of a printing system component. The curing assembly 136 is positioned along the media path in a printing apparatus 104 that uses a curable ink to cure the ink ejected onto the continuous web 120 before the ejected ink contacts any of a series of rollers, including roller 196, which guide the continuous web 120 along the media path. As shown in FIG. 9, the printing apparatus 104 enables ink ejected onto the continuous web 120 to be cured before being contacted by the roller 202. The curing assembly 136 may be any device configured to cure ink. As shown in FIG. 6, the curing assembly 136 may be a discharge lamp 200 configured to expose the ink ejected onto the continuous web 120 to radiation. Specifically, the discharge lamp 200 may be a mercury vapor lamp configured to emit ultraviolet radiation at an intensity or power level configured to cure UV curable gel ink. As shown in FIG. 7, the curing assembly 136 may also be a group or an array of light emitting diodes ("LEDs") 204 configured to emit ultraviolet radiation. Both the discharge lamp 200 and the LEDs 204 are selectively coupled to a source of electrical energy. The intensity of the radiation emitted by each embodiment of the curing assembly 136 depends on, among other factors, the speed of the continuous web 120, the amount of ink ejected onto the continuous web 120, and the color of the ink to be cured.

The printhead arrays 128 are configured to eject ink onto the continuous web 120 with a predetermined print resolution. The term "print resolution", as used herein, refers to the number of ink droplets ejected onto an image receiving surface within a defined length. Print resolution may be measured in the process direction 144 and in a cross process direction 146 (FIG. 8), which is perpendicular to the process direction 144. Print resolution is often measured in dots per inch ("dpi"). For example, a printhead array 128 having a print resolution of three hundred (300) dpi is capable of ejecting three hundred (300) ink droplets onto the continuous web 120 within one (1) linear inch.

The process direction print resolution of an ink color or type ejected by a printhead array 128 may be configured by adjusting the web speed, the frequency of the firing signals sent to the printhead arrays 128, and/or the total number of inkjet ejectors aligned on a common line along the process direction 144 that are configured to eject ink, among other characteristics of the printing apparatus 104. For example, the process direction print resolution can be increased by reducing the web speed, by increasing the frequency of the firing signals, and/or by increasing the total number of aligned ejectors along the process direction 144. Alternatively, the process direction print resolution can be decreased by increasing the web speed, by decreasing the frequency of the firing signals, and/or by decreasing the total number of aligned ejectors along the process direction. In one embodiment, each printhead array 128 of the printing system 100 ejects ink droplets with the same process direction print resolution. In another embodiment, however, a first printhead array 128 ejects ink droplets with a process direction print resolution that is different from the process direction print resolution of the ink droplets ejected by at least one other printhead array 128.

The cross process direction print resolution of each ink color and type ejected by the printing apparatus 104 may also be configured. For instance, the cross process direction print resolution of an ink ejected by a printhead array 128 may be reduced by ejecting ink onto the continuous web 120 with less than all of the inkjet ejectors. The cross process direction print resolution of an ink color or type ejected by a printing apparatus 104 may be increased by ejecting the same ink color or type with more than one printhead array 128, as described below.

Each printhead array 128 ejects ink droplets with a resolution measured in the cross process direction that is limited by the number of ink ejectors per unit length as measured in the cross process direction 146. The cross process direction print resolution of an ink ejected by a first printhead array 128 may by increased by positioning a second printhead array 128 to eject ink droplets of the first ink color or type between the ink droplets ejected by the first printhead array 128 in the cross process direction. Accordingly, a printing apparatus 104 having more than one printhead array 128 may be configured to eject a first ink color or type at a first cross process direction print resolution and to eject a second ink color/composition at a second cross process direction print resolution. Additionally, each printhead array 128 may eject ink with the same cross process direction print resolution. Furthermore, one or more printhead arrays 128 may eject ink with a cross process direction print resolution that is different from the cross process direction print resolution of at least one other printhead array 128.

To configure a group of printhead arrays 128 for a combined cross process direction print resolution, the printhead arrays 128 must be positioned such that the ink droplets ejected by each printhead array 128 are ejected between the ink droplets ejected by each other printhead array 128 in the group of printhead arrays 128. In particular, one or more printhead arrays 128 in the group of printhead arrays 128 may be moved in the cross process direction 146 to enable the ink droplets ejected by each printhead array 128 to be interlaced with the ink droplets ejected by each other printhead array 128 in the group of printhead arrays 128. The group of printhead arrays 128, when positioned as described, ejects ink with a cross process direction print resolution greater than the cross process direction print resolution of any one printhead array 128. The printing apparatus 104 may print a test pattern to aid a user in determining if the printhead arrays 128 are positioned as described.

A manufacturer may configure a printing apparatus 104 and a printing system 100 according to a set of printing specifications. As used herein, the term "manufacturer" refers to an organization, subset of an organization, or any other person or group of individuals other than the end user of the printing apparatus 104 or the printing system 100. An exemplary set of printing specifications may describe a printing system 100 that prints twelve (12) colors of a solid ink. Additionally, the exemplary set of printing specifications may specify that a first color of the solid ink is to be printed at a resolution that is different from the resolution of each other color or type of the solid ink. To configure the printing system 100 the manufacturer connects a suitable set of printing system components to a suitable number of frames 140 to form the printing system 100. Typically, the fewest possible number of frames 140 are utilized. Next, one or more of the printhead arrays 128 in a printing apparatus 104 may be positioned to increase the cross process direction print resolution of the first ink color. Typically, a printing system 100 configured to print images with curable ink, such as a printing system utilizing the printing apparatus 104 of FIG. 4, requires more frames 140 per ink color, because the last two (2) mounting locations 156 of each frame 140 of each printing apparatus 104 are occupied by an ink leveling device 132 and a curing device 136. Other printing systems 100, however, may not require a greater number of printing apparatus 104 per ink color when configured to print images with curable ink, such as the printing apparatus of FIGS. 9 and 10.

Another exemplary set of printing specifications may describe a printing system 100 that prints eight (8) colors of a curable ink composition. To configure the printing system 100, the manufacturer connects a suitable set of printing system components to a suitable number of frames 140 to form the printing system 100. Typically, the fewest possible number of frames 140 are utilized. Next, one or more of the printhead arrays 128 in the printing apparatus 104 may be positioned to increase the cross process direction print resolution of the first ink color, if specified in the printing specification.

A printing system 100 may be configured by a manufacturer to print images with any number of ink colors or types of a particular ink composition. Additionally, each color or type of the ink composition may be printed with a cross process direction print resolution that is different from the cross process direction print resolutions of some or all of the other ink colors or types. Furthermore, each printhead array 128 of a printing system 100 may eject an ink color or type that is different than the ink color or type ejected by any other printhead array 128 in the system 100. Each printhead array 128 of a printing apparatus 104 may eject the same color or type of an ink composition.

As noted above, a registration processor 220 is configured to generate firing signals for printhead arrays 128 within a printing apparatus 104 to register ink images. As used herein, the term "register" refers to positioning ink ejected onto the continuous web 120 properly. Registration may refer to images printed by different printhead arrays 128 within a printing apparatus 104 or to images printed by one printing apparatus 104 with reference to images printed by another printing apparatus 104. As used herein, the term "subsequent printer" refers to a printing apparatus 104 configured to receive the continuous web 120 from another printing apparatus 104 instead of the web supply 108, and the term "prior printer" refers to a printing apparatus 104 configured to feed the continuous web 120 to a subsequent printing apparatus 104 instead of directly to the rewinder 112. Depending on the reference point, a printing apparatus 104 may be both a subsequent printing apparatus 104 and a prior printing apparatus 104.

In more detail, a registration processor 220 is communicatively coupled to an imaging device 212, a positioning device 214, at least two load sensors 216, and at least two encoders 218 to enable ink images to be registered in the process direction 144 and the cross process direction 146. In a first printing apparatus 104 in a printing system 100, the imaging device 212 is mounted subsequent to the printhead arrays 128 to image the image receiving surface and provide image data corresponding to the image receiving surface to the registration processor 220. The registration processor 220 uses the angular velocity data from the encoders 218 and the tension measurements from the load sensors 216 to compute a velocity for the continuous web 120 and to generate firing signals for the printheads in the printhead arrays 128. The registration processor 220 uses the image data to detect registration errors and, if possible, the registration processor uses computations from the web velocity to adjust the firing signals for the printhead arrays 128 to attenuate the registration errors detected from the image data. In subsequent printing apparatus 104, an imaging device 212 may be coupled to the frame 140 of the subsequent printing apparatus 104 that enables generation of image data corresponding to the image receiving surface received from a prior printing apparatus 104. The registration processor 220 in this subsequent printing apparatus 104 receives image data from the imaging device 212 corresponding to the ink images printed on the image receiving surface by the prior printing apparatus 104, the load sensors 216, and the encoders 218. The registration processor 220 uses these data to compute a web velocity and to generate the firing signals for the printheads in the printhead arrays 128 mounted to the frame 140 of this subsequent printing apparatus 104. Thus, the registration processor of a subsequent printing apparatus 104 uses image data regarding the ink images printed by the prior printing apparatus 104 to enable proper registration of the ink ejected by the printhead arrays 128. Additionally, the registration processor 220 generates control signals for the positioning device 214 that operate the positioning device 214 to move the continuous web 120 in a direction that is approximately perpendicular to the process direction 144 in order to register the ink pattern in the cross process direction 146.

The imaging device 212 may be implemented with an image-on-web array ("IOWA") sensor that generates image data of an ink pattern on the continuous web 120 as the continuous web 120 moves through a printing apparatus 104. The IOWA sensor may be implemented with a plurality of optical detectors that are arranged in a single or multiple row array that extends across the entirety or at least a portion of the width of the continuous web 120. The detectors generate signals having an intensity that corresponds to a light reflected off the continuous web 120. The light is generated by a light source that is incorporated in the IOWA sensor and directed toward the surface of the continuous web 120 to illuminate the surface as it passes the optical detectors. The intensity of the reflected light is dependent upon the amount of light absorbed by the ink on the continuous web, the light scattered by the structure of the continuous web 120, and the light reflected by the ink and continuous web 120, among other factors. The image data generated by the IOWA is sent to the registration processor 220.

Figure 8:
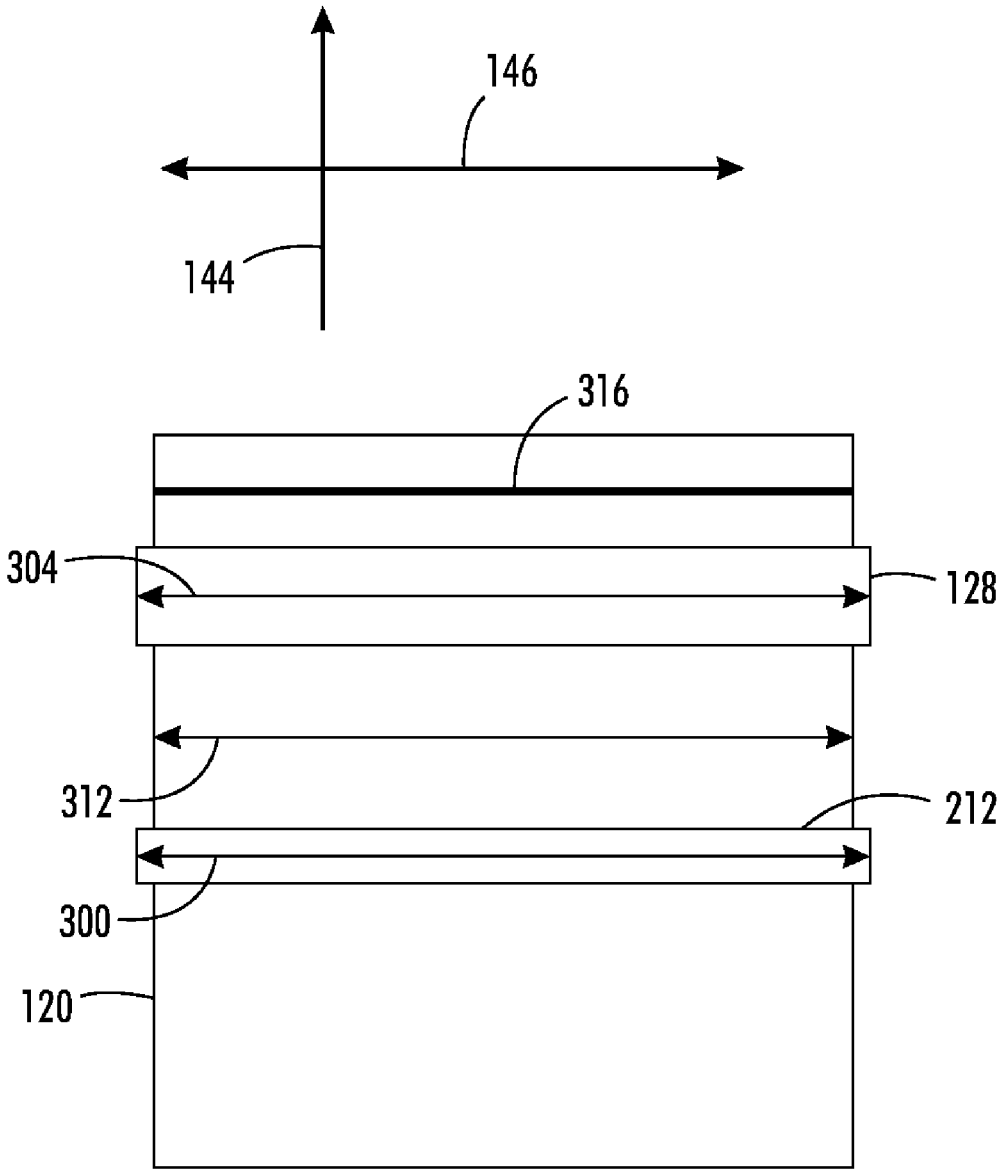
FIG. 8 illustrates a portion of a printing apparatus of the printing system of FIG. 1, a full width imaging device is coupled to the portion of the printing apparatus.

The imaging device 212 may be configured to image a predetermined width of the image receiving surface. A "full width" imaging device 212 is shown in FIG. 8. A full width imaging device 212 has an imaging width 300 that is equal to or greater than a print width 304 of each printhead array 128 of a printing apparatus 104. The term "print width", as used herein, refers to the width of the region of the continuous web 120 onto which a printhead array 128 is configured to eject ink. The print width 304 may be approximately equal to a web width 312 of the continuous web 120, such that the printhead array 128 may eject ink across the entire web width 312 of the continuous web 120. A full width imaging device 212 images the continuous web 120 to generate image data across the entire print width 304 of each printhead array 128 of a printing apparatus 104. A full width imaging device 212 may be implemented with an IOWA sensor having a plurality of optical detectors that span the print width 304.

The imaging device 212 may be configured to detect a registration pattern 316 printed on the continuous web 120. The registration pattern 316 is an ink pattern printed onto an image receiving surface that extends across all or a portion of the print width 304. A full width imaging device 212, such as a full width IOWA sensor, may be used to generate image data of a registration pattern 316 that extends fully across the print width 304. As shown in FIG. 8, the registration pattern 316 may be printed in the inter-document zone of the continuous web 120. The registration processor 220 receives the image data corresponding to the image of the registration patterns 316. The registration processor 212 generates firing signals for the printhead arrays 128 with reference to the image data of the registration patterns 316.

The registration processor 220 is coupled to the frame 140 of a printing apparatus 104. Each printing apparatus 104 may have a separate registration processor 220 to which the imaging device 212, load sensors 216, and encoders 218 are communicatively coupled. Alternatively, a printing system 100 may include a single registration processor 220 to which the imaging device 212, load sensors 216, and encoders 218 of each printing apparatus 104 in the printing system 100 are communicatively coupled. The registration processor 220 may be a self-contained, dedicated computer having a central processing unit ("CPU"), electronic data storage, and a display or user interface ("UI"). The registration processor 220 may be implemented with general or specialized programmable processors that execute programmed instructions. The instructions and data required to perform the programmed functions may be stored in memory associated with the processors or controllers. The processors, their memories, and interface circuitry configure the registration processor 220 to perform the processes, described more fully above, that enable the registration of ink images ejected onto the image receiving surface by each printhead array 128. The components of the registration processor 220 may be provided on a printed circuit card or provided as a circuit in an application specific integrated circuit ("ASIC"). Each of the circuits may be implemented with a separate processor or multiple circuits may be implemented on the same processor. Alternatively, the circuits may be implemented with discrete components or circuits provided in very large scale integration ("VLSI") circuits. Also, the circuits described herein may be implemented with a combination of processors, ASICs, discrete components, or VLSI circuits.

In operation, the printing system 100 is configured to form printed images with a particular ink composition. After each printing apparatus 104 has been configured by the manufacturer with a set of printing system components, the printing system 100 may be operated to form printed images on an image receiving surface. For example, as shown in FIG. 3, a first set of printing system components, including six printhead arrays 128, may be coupled to the locations 156 to configure the printing apparatus 104 to form images with an ink composition that does not require a curing device or a non-contact leveling device, such as phase change ink. Alternatively, as shown in FIG. 4, a second set of printing system components, including four printhead arrays 128, an ink leveling device 132, and a curing device 136, may be coupled to the locations 156 to configure the printing apparatus 104 to form printed images with a curable ink, such as UV gel ink. Accordingly, the same frame 140 may be used regardless of the desired ink composition to simplify the assembly process of the printer apparatus 104. Below, the operation of the printing system components is described for both UV gel ink configurations and solid ink configuration of the printing apparatus 104.

To print images with UV gel ink, the ink sources 124 are filled with UV gel ink. Next, the printhead arrays 128 heat the UV gel ink to an altered viscosity suitable for ejection. The actuator 116 is then activated to pull the continuous web 120 past each printing system component coupled to the frame 140. As the continuous web 120 moves past the printing system components, the printhead arrays 128 eject ink droplets onto the continuous web 120. The ink leveling device 132 is positioned to level the ink droplets ejected onto the continuous web 120 by each printhead array 128. The UV curing assembly 136 cures the ink ejected onto the continuous web 120 after the ink droplets have been leveled. Once the ink is cured, the ink may be contacted by roller 196 and other web guiding structures without affecting the printed image.

To print images with phase change ink, the ink sources 124 are filled with phase change ink. Next, the printhead arrays 128 heat the phase change ink to the liquid phase. After the phase change ink is heated to the liquid phase, the actuator 116 may be activated to pull a continuous web 120 from a web supply 108 past each printing system component coupled to the frame 140. As the continuous web 120 moves past the frame 140, the printhead arrays 128 eject ink droplets of phase change ink onto the surface of the continuous web 120. The ink spreader 206 spreads the ink droplets in a substantially continuous area.

The printing system 100 is configured to form printed images with any number of ink colors and/or types of a particular ink composition. In particular, the phase change ink printing system of FIG. 3 is configured to form printed images with at most six ink colors or types of phase change ink. To print images with additional colors and/or types of phase change ink, multiple printing apparatus 104 may be serially connected together. For instance, to print an image with twelve different colors of phase change ink, two of the printing apparatus 104 illustrated in FIG. 3 may be serially connected to form a media path that extends through both printing apparatus 104. Specifically, after the continuous web 120 exits the first printing apparatus 104 it enters the next printing apparatus 104 in the chain of printing apparatus 104 until the continuous web 120 exits the last printing apparatus 104 of the printing system 100. The registration apparatus 208, shown in FIG. 3 and FIG. 4, of each printing apparatus 104 registers the image formed by a subsequent printing apparatus 104 with the image formed by each prior printing apparatus 104. Only one actuator 116 is required to pull the continuous web 120 through the printing system 100.

Although the printing system 100 is described as a direct printing system, the printing system 100 may also be an indirect printing system. As the term is used herein, a "direct" printing system is a printing system in which the printhead arrays 128 eject ink directly onto a print medium such as the continuous web 120. An "indirect" printing system, as the term is used herein, is a printing system 100 in which the printhead arrays 128 eject ink onto an intermediate surface (not illustrated). The ink ejected onto the intermediate surface is transferred to a print medium such as the continuous web 128. The intermediate surface may be a drum, belt, band, platen, or any other suitable surface for receiving and transferring ink. For example, the intermediate surface may include one or more rotatably mounted drums. Each drum receives ink from one or more printhead arrays 128 and transfers the ink to the continuous web 120, which is configured to contact the rotating drum as the continuous web 120 moves along a media path through the printing apparatus 104.

The printing system 100 may be configured for simplex and duplex printing operations. To complete a simplex printing operation, at least one printing apparatus 104 prints an image on a first side of the continuous web 120. To complete a duplex printing operation, at least one printing apparatus 104 prints an image on the first side of the continuous web 120, and at least one printing apparatus 104 prints an image on a second side of the continuous web 120. A printing system 100 configured to perform duplex printing operations includes an inversion device. The inversion device is configured to invert the continuous web 120, as is known in the art.

The inversion device may be positioned to receive the continuous web 120 as the continuous web 120 exits a first printing apparatus 104 and before the continuous web 120 enters a second printing apparatus 104. In this configuration, the first printing apparatus 104 prints an image on the first side of the continuous web 120 and the second printing apparatus 104 prints an image on the second side of the continuous web 120. The inversion device may also be positioned subsequent to each printing apparatus 104 of the printing system 100. In this configuration, a continuous web 120 having a width equal to approximately half of the print width 304 is routed through each printing apparatus 104 of the printing system 100 to receive ink on the first side of the continuous web 120. After exiting the last printing apparatus 104 as measured in the process direction 144, the continuous web 120 is received by the inversion device. Next, the inverted continuous web 120 is routed again through each printing apparatus 104 of the printing system 100 to receive ink on the second side of the continuous web 120. The inverted portion of the continuous web 120 and the non-inverted portion of the continuous web 120 move along the media path adjacent to each other.

As shown in FIGS. 9 and 10, the printing system 100 includes an alternative embodiment of the printing apparatus 104. The printing apparatus 104 includes printhead arrays 128, an ink spreader 132, an ink curing device 136, an imaging device 212, a temperature control roller 250, and a temperature control roller 254. The printhead arrays 128 are positioned to eject ink droplets onto the continuous web 120 as the continuous web moves along an approximately arcuate media path located between a roller pair 258 or a roller 260 (FIG. 10) and the roller 250. Accordingly, the printhead arrays 128 eject ink onto the continuous web 120 in a generally downward direction. The temperature control rollers 250, 254 control the temperature of the continuous web 120 and the ink ejected upon the continuous web 120, as is known in the art. In particular, the rollers 250, 254 may heat the continuous web 120 such that the ink ejected upon the continuous web may be leveled properly by the ink spreader 132 and cured properly by the curing device 136. The ink spreader 132 and the curing device 136 are positioned to spread and cure the ink ejected onto the continuous web 120 before the ink undergoes contact with a pressure bearing structure surface, such as the roller 202.

As shown in FIG. 10, the printing apparatus 104 includes printhead arrays 128, an ink spreader 132, an ink curing device 136, an imaging device 212, a temperature control roller 250, and a temperature control roller 254. The printhead arrays 128 are positioned to eject ink droplets onto the continuous web 120 as the continuous web moves along an approximately arcuate media path located between the roller 260 and the roller 250. Accordingly, the printheads 128 eject ink onto the continuous web 120 in a generally downward direction. The printing apparatus 104 includes ink sources 124 coupled to the printheads 128. The printing apparatus of FIG. 10 is operable to print images with eight colors of curable ink, as shown by the eight printhead arrays 128 and the eight ink sources 124. The temperature control rollers 250, 254 control the temperature of the continuous web 120 and the ink ejected upon the continuous web 120, as is known in the art. In particular, the rollers 250, 254 heat the continuous web 120 such that the ink ejected upon the continuous web may be leveled properly by the ink spreader 132 and cured properly by the curing device 136. The ink spreader 132 and the curing device 136 are positioned to spread and cure the ink ejected onto the continuous web 120 before the ink undergoes contact with a pressure bearing structure surface, such as the roller 202.

Those skilled in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus comprising:

a frame configured to support a plurality of components to form a printing system, the frame including a plurality of mounting locations;

a plurality of printing system components including at least one printhead array and at least one first ink composition curing assembly, each printing system component in the plurality of printing system components being configured to mount to a mounting location on the frame;

the printing apparatus being enabled to eject a first ink composition onto an image receiving surface and cure the first ink composition on the image receiving surface in response to a first set of printing system components being selected from the plurality of printing system components and mounted to the frame to form a printing apparatus that ejects and cures the first ink composition onto an image receiving surface, the first set of printing system components being less than all of the plurality of printing system components and including the at least one first ink composition curing assembly; and the printing apparatus being enabled to eject a second ink composition onto an image receiving surface in response to a second set of printing system components being selected from the plurality of printing system components and mounted to the frame to form a printing apparatus that ejects the second ink composition onto an image receiving surface and cannot eject the first ink composition onto the image receiving member, the second set of printing system components not being mounted to the frame when the first set of printing components are mounted to the frame and the second set of system components not including the at least one first ink composition curing assembly.

2. The printing apparatus of claim 1, the frame being further configured to orient a printhead array mounted to the frame to eject ink vertically onto the image receiving surface as the image receiving surface moves horizontally past the printhead array.

3. The printing apparatus of claim 1, the frame being further configured to orient a printhead array mounted to the frame to eject ink horizontally onto the image receiving surface as the image receiving surface moves vertically past the printhead array.

4. The printing apparatus of claim 1, wherein the first ink composition is an ink composition that is cured with ultraviolet radiation and the second ink composition is a liquid ink that is not cured with ultraviolet radiation.

5. The printing apparatus of claim 1, the image receiving surface being a continuous web of print medium.

6. The printing apparatus of claim 1, the image receiving surface being a series of media sheets.

7. The printing apparatus of claim 1, the plurality of printing system components further comprising:

an air knife configured to spread ink droplets ejected onto the image receiving surface into a substantially continuous area.

8. The printing apparatus of claim 1, the plurality of printing system components further comprising:

an infrared radiation emitter configured to radiate ink droplets ejected onto the image receiving surface to spread the ink droplets into a substantially continuous area.

9. The printing apparatus of claim 1, the first ink composition curing assembly further comprising:

a plurality of light emitting diodes configured to emit radiation having a wavelength that cures ink ejected onto the ink receiving surface by at least one printhead array mounted to the frame.

10. A printing system comprising:

a first frame configured with a first plurality of printing system component mounting locations;

a second frame configured with a second plurality of printing system component mounting locations; and a plurality of printing system components including at least two printhead arrays and at least two first ink composition curing assemblies;

each frame being configurable to form a printing apparatus that ejects a first ink composition or a second ink composition onto an image receiving surface, one of the first and the second frames being configured to form a printing apparatus that ejects a first ink composition when a first set of printing system components selected from the plurality of printing system components is mounted to the frame, the first set of printing system components being less than all of the plurality of printing system components and including at least one first ink composition curing assembly, and the other of the first and second frames being configured to form a printing apparatus that ejects a second ink composition and cannot eject the first ink composition when a second set of printing system components is mounted to the frame, the second set of printing system components being less than all of the printing system components and the second set of printing system components does not include the first ink composition curing assembly; and the printing apparatus formed on the second frame is configured to receive the image receiving surface from the printing apparatus formed on the first frame after the printing apparatus formed on the first frame has ejected ink onto the image receiving surface.

11. The printing system of claim 10 wherein the first set of printing system components is mounted to the first frame and the second set of printing system components is mounted to the second frame, and the printing apparatus formed on the first frame is configured to level and cure ink ejected onto the image receiving surface before the image receiving surface is received by the printing apparatus formed on the second frame.

12. The printing system of claim 10, further comprising:

an imaging device configured to generate image data of the image receiving surface after the image receiving surface passes a last mounting position in the printing apparatus formed on the first frame, the imaging device being configured to generate image data corresponding to a predetermined width of the image receiving surface; and a registration processor communicatively coupled to the imaging device to receive image data generated by the imaging device, the registration processor being configured to generate firing signals for printhead arrays mounted to the second frame with reference to the image data received from the imaging device.

13. The printing system of claim 10 further comprising:

a third frame configured with a third plurality of mounting locations;

the plurality of printing system components including at least one more printhead array and at least one more first ink composition curing assembly; and the third frame being configurable to form a printing apparatus that ejects the first ink composition or the second ink composition onto an image receiving surface when either the first set of printing system components or the second set of printing system components, respectively, is mounted to the third frame; and the printing apparatus formed on the third frame is configured to receive the image receiving surface from the printing apparatus formed on the second frame after the printing apparatus formed on the second frame has ejected ink onto the image receiving surface.

14. The printing system of claim 13 wherein each printhead array mounted on each frame ejects a color of ink that is different than a color of ink ejected by any other printhead array mounted to any frame in the printing system.

15. The printing system of claim 13 wherein at least two printhead assemblies mounted on one of the three frames ejects a same color of ink that is different than a color of ink ejected by any other printhead array mounted to any frame in the printing system, the at least two printhead arrays ejecting the same color of ink being configured to eject the same color of ink at a resolution that is different than the color of ink that is ejected by only one printhead array mounted to any frame.

16. The printing system of claim 10 wherein one printhead array mounted to one of the two frames ejects cyan colored ink, one printhead array mounted to one of the two frames ejects magenta colored ink, one printhead array mounted to one of the two frames ejects yellow colored ink, and one printhead array mounted to one of the two frames ejects black colored ink, and the four printhead arrays are arranged in an order that does not eject cyan colored ink, followed by magenta colored ink, followed by yellow colored ink, followed by black colored ink.

17. The printing system of claim 10 wherein each frame is configured with the first set of printing system components to enable each printing apparatus formed on the first and the second frames to eject the first ink composition, and the first ink composition is a gel form of an ink that is cured with ultraviolet radiation.

18. The printing system of claim 10 wherein each frame is configured with the first set of printing system components to enable each printing apparatus formed on the first and the second frames to eject the first ink composition, the first ink composition being an ink that is cured with ultraviolet radiation and the first set of printing system components including at least one pinning lamp that is configured to retard absorption of the first ink composition into the image receiving surface before the ink ejected on the image receiving surface is leveled and cured.

19. The printing system of claim 11 wherein the printing apparatus formed on the second frame is configured to level and cure ink ejected onto the image receiving surface after all printhead arrays mounted to the second frame have ejected ink onto the image receiving surface.

20. The printing apparatus of claim 10, each of the frames being configured to orient a printhead array mounted to one of the frames to eject ink vertically onto the image receiving surface as the image receiving surface moves horizontally past the printhead array.

* * * * *